US006619968B2

(12) United States Patent
Xu

(10) Patent No.: US 6,619,968 B2
(45) Date of Patent: Sep. 16, 2003

(54) ELECTRICAL CONNECTOR HAVING TERMINAL INSERTS

(75) Inventor: Xiang Xu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/013,395

(22) Filed: Dec. 7, 2001

(65) Prior Publication Data

US 2003/0109151 A1 Jun. 12, 2003

(51) Int. Cl.[7] ..... H01R 9/09

(52) U.S. Cl. ..... 439/79; 439/567

(58) Field of Search ..... 439/79, 567, 607, 439/571, 572, 609, 358

(56) References Cited

U.S. PATENT DOCUMENTS

| | | | | | |
|---|---|---|---|---|---|
| 6,077,115 | A | * | 6/2000 | Yang et al. | 439/567 |
| 6,203,367 | B1 | * | 3/2001 | Wu | 439/567 |
| 6,210,218 | B1 | * | 4/2001 | Chang | 439/567 |
| 6,379,181 | B1 | * | 4/2002 | Chang et al. | 439/567 |

* cited by examiner

*Primary Examiner*—P. Austin Bradley
*Assistant Examiner*—Phuongchi Nguyen
(74) *Attorney, Agent, or Firm*—Wei Te Chung

(57) ABSTRACT

An electrical connector (1) comprises an insulating housing (10) defining a number of terminal receiving channels (140) and a first and a second openings (102, 104) in communication with the receiving channels, and a pair of terminal inserts (20, 30) respectively inserted into the first and the second openings. Each terminal insert includes an insulating portion (22, 32) and a number of terminals (24, 34) retained in the insulating portion. Each terminal has a mating portion (240, 340) received in a corresponding terminal receiving channel of the housing.

6 Claims, 6 Drawing Sheets

ELECTRICAL CONNECTOR HAVING TERMINAL INSERTS

BACKGROUND OF THE INVENTION

1. Field of the Invention

The present invention relates to an electrical connector, and particularly to an electrical connector having terminal inserts individually assembled for accurately positioning terminals in an insulating housing thereof.

2. Description of Related Art

As shown in FIG. 6, a conventional electrical connector comprises an insulating housing 8 including a base 80 and a shroud 82 forwardly projecting from a front face of the base 80, a spacer 200 located at a rear, lower portion of the housing 8, and an integral terminal module 90 received in the housing 8. The housing 8 defines a plurality of terminal receiving channels (not shown) in the shroud 82, and an opening 84 extending through the base 80 in communication with the terminal receiving channels. The integral terminal module 90 includes a first and a second terminal inserts 91, 92 interconnected together. The first terminal insert 91 has a first insulating portion 910 with first protrusions 9100 formed on a top face thereof, and a plurality of terminals 100 secured to the first insulating portion 910. The second terminal insert 92 has a second insulating portion 920 with second protrusions (not shown) formed on a bottom face thereof, and a plurality of terminals 100 secured to the second insulating portion 920. The first and the second terminal inserts 91, 92 are fixed together via locking members (not shown) formed on a bottom face of the first insulating portion 910 and a top face of the second insulating portion 920. The terminals 100 are assembled to the housing 8 by inserting the integral terminal module 90 into the opening 84 to reach a position in which the first protrusions 9100 and the second protrusions fit into corresponding holes 800 defined in the base 80, mating portions 100*a* of the terminals 100 are received in the receiving channels, and tail portions 100*b* of the terminals 100 extend through the spacer 200.

However, the inevitable assembling tolerance between the first and the second terminal inserts 91, 92 may result in a misalignment between the mating portions 100*a* of the terminals 100 and the terminal receiving channels, thus making the terminals 100 incorrectly and unreliably positioned in the housing 8. As a result, the electrical connection between the electrical connector and a complementary connector may be adversely affected.

Hence, an electrical connector having terminal inserts individually assembled is required to overcome the disadvantages of the related art.

SUMMARY OF THE INVENTION

Accordingly, the main object of the present invention is to provide an electrical connector having terminal inserts individually assembled for accurately positioning terminals in terminal receiving channels of an insulating housing thereof.

In order to achieve the object set forth, an electrical connector in accordance with the present invention comprises an insulating housing defining a plurality of terminal receiving channels and a first and a second openings in communication with the terminal receiving channels, and a pair of terminal inserts respectively inserted into the first and the second openings. Each terminal insert includes an insulating portion and a plurality of terminals retained in the insulating portion. The insulating portion is formed with a plurality of protrusions on a top and a bottom faces thereof. Each terminal includes a mating portion received in a corresponding terminal receiving channel of the housing. The housing defines a plurality of holes and the partition defines a plurality of recesses on a top and a bottom faces thereof for locking the protrusions of the terminal inserts therein. The partition is formed with a plurality of ribs on a top and a bottom faces thereof projecting into the first and the second openings for abutting against the first and the second terminal inserts. Thus, the mating portions of the terminals are accurately positioned in the terminal receiving channels of the housing.

Other objects, advantages and novel features of the invention will become more apparent from the following detailed description when taken in conjunction with the accompanying drawings.

DETAILED DESCRIPTION OF THE INVENTION

Figure 1:
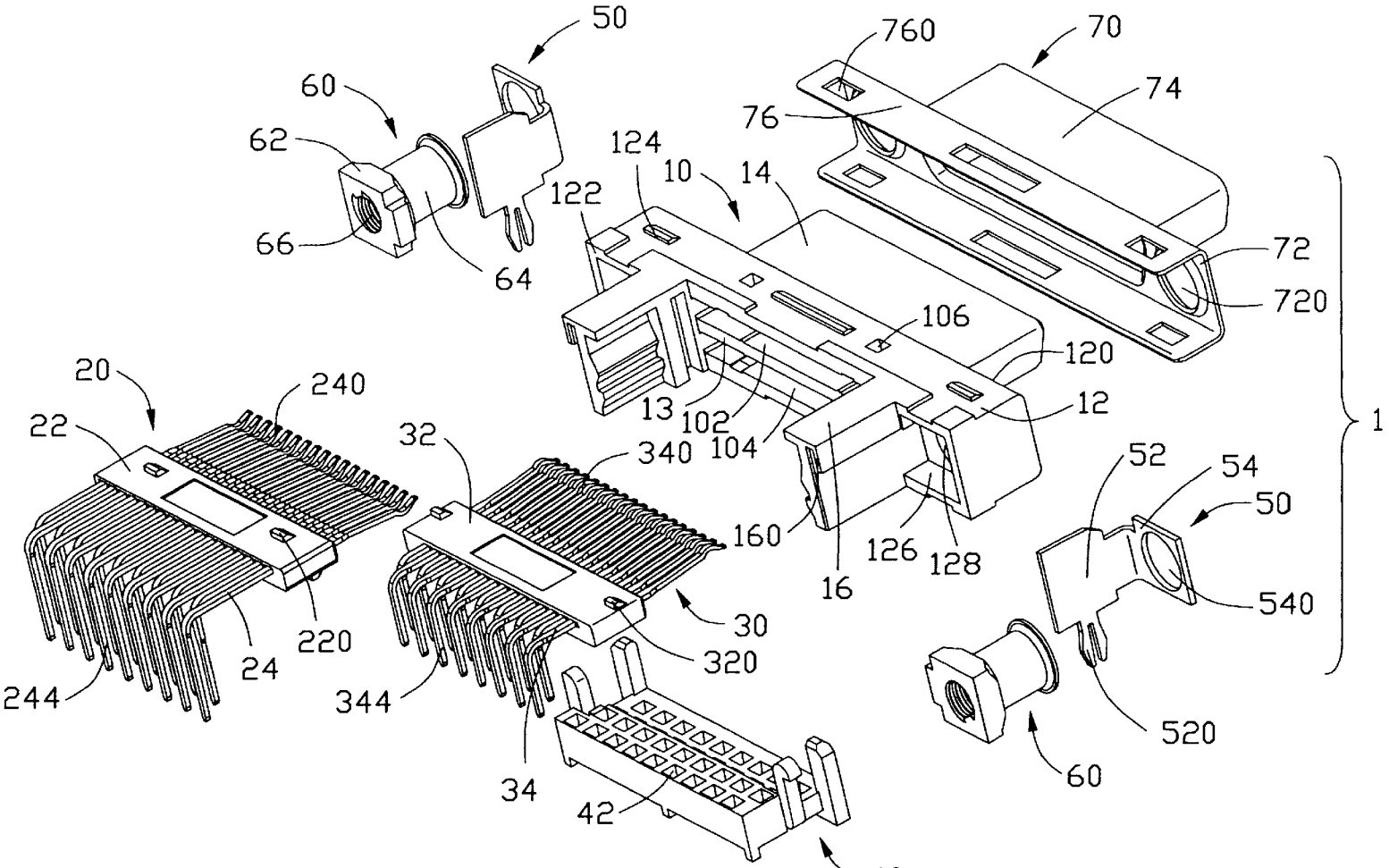
FIG. 1 is an exploded, perspective view of an electrical connector having terminal inserts individually assembled in accordance with the present invention.
Figure 2:
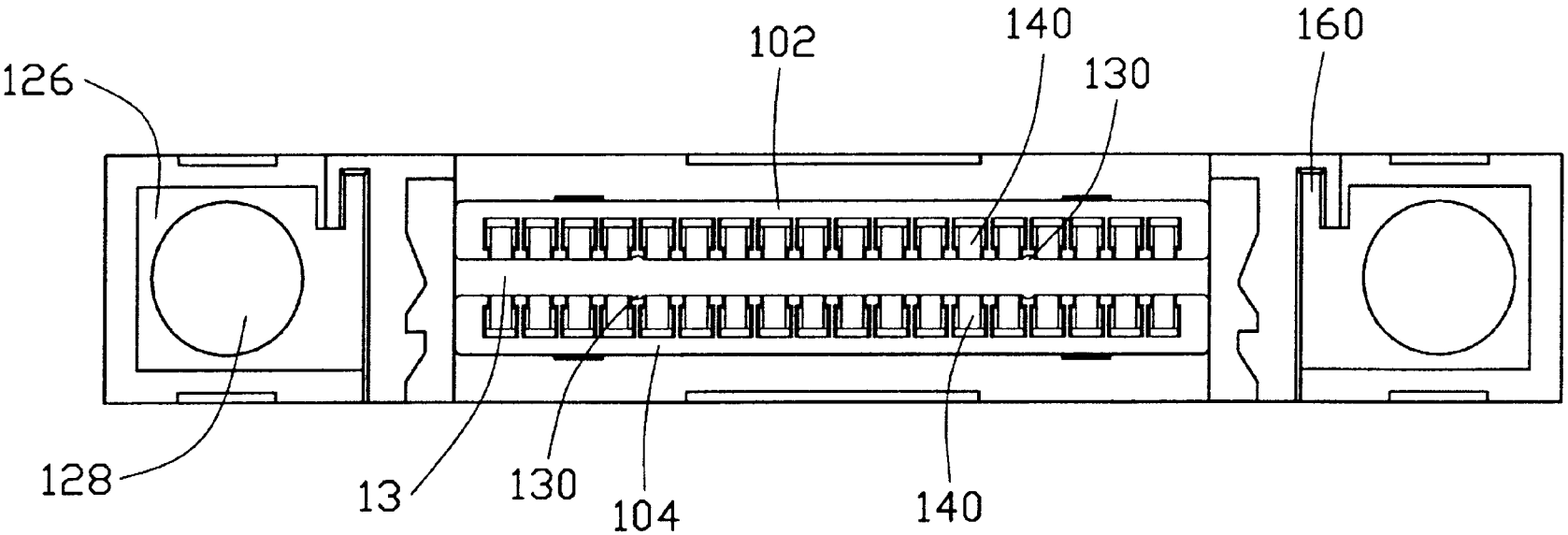
FIG. 2 is a rear, plan view of an insulating housing of the connector of FIG. 1.

Referring to FIGS. 1 and 2, an electrical connector 1 having a pair of terminal inserts in accordance with the present invention comprises an insulating housing 10, a first and a second terminal inserts 20, 30 for being received in the housing 10, a spacer 40 for being positioned at a rear, lower portion of the housing 10, a pair of board locks 50 for being secured on opposite ends of the housing 10, a pair of fastening members 60 for engaging with the board locks 50, and a shield 70 for enclosing the housing 10.

The housing 10 includes a base 12, a shroud 14 forwardly extending from a front face 120 of the base 12, and a pair of blocks 16 rearwardly extending from a rear face 122 of the base 12. The spacer 40 is retained between the blocks 16 with a plurality of holes 42 defined in four rows in a staggered manner. The housing 10 defines a plurality of terminal receiving channels 140 in the shroud 14, and a first and a second openings 102, 104 in the rear face 122 of the base 12 to communicate with the terminal receiving channels 140. The first and the second openings 102, 104 are separated by a partition 13. The partition 13 is formed with a plurality of ribs 130 on a top and a bottom faces thereof projecting into corresponding first and second openings 102, 104. The partition 13 also defines a plurality of recesses 110 (FIG. 5) on the top and the bottom faces thereof. The base 12 defines a plurality of first holes 106 communicating with the first opening 102, and a plurality of second holes 108 (only one being shown in FIG. 5) communicating with the second opening 104.

A plurality of protrusions 124 are formed on a top and a bottom faces of the base 12. The base 12 defines a pair of recesses 126 in the rear face 122 at opposite ends thereof, and a pair of apertures 128 in the front face 120 each in communication with a corresponding recess 126. Each block 16 also defines a slot 160 in an outer face communicating with a corresponding recess 126.

Each terminal insert 20 or 30 includes an insulating portion 22 or 32, and a plurality of terminals 24 or 34 retained in the insulating portion 22 or 32. The insulating portion 22 or 32 is formed with a plurality of projections 220 or 320 on a top and a bottom faces thereof. Each terminal 24 (34) has a mating portion 240 (340) projecting beyond a front face of the insulating portion 22 (32) for engaging with a corresponding terminal of a complementary connector (not shown), a retention portion (not shown) embedded in the insulating portion 22 (32), and a right-angle tail portion 244 (344) projecting beyond a rear face of the insulating portion 22 (32) for electrical connection with a printed circuit board on which the electrical connecter 1 is mounted.

Each board lock 50 includes a body portion 52, and a connecting portion 54 perpendicularly extending from a side edge of the body portion 52. The body portion 52 has a pair of spaced legs 520 downwardly extending from a bottom edge thereof for electrical connection with the printed circuit board. The connecting portion 54 defines a through hole 540 therein.

Each fastening member 60 includes a planar head portion 62, and a cylindrical locking portion 64 integrally extending from the head portion 62. The fastening member 60 defines a screw hole 66 extending along an axial direction of the cylindrical locking portion 64 and secures the board lock 50 to the housing 10 by riveting a front end of the locking portion 64.

The shield 70 includes an abutting portion 72 for abutting against the front face 120 of the housing 10, a shielding portion 74 enclosing the shroud 14, and a pair of rearwardly extending flanges 76. The flanges 76 define a plurality of holes 760 for engaging with the protrusions 124 of the housing 10. The abutting portion 72 defines a pair of fixing holes 720 corresponding to the apertures 128 of the housing 10.

Figure 3:
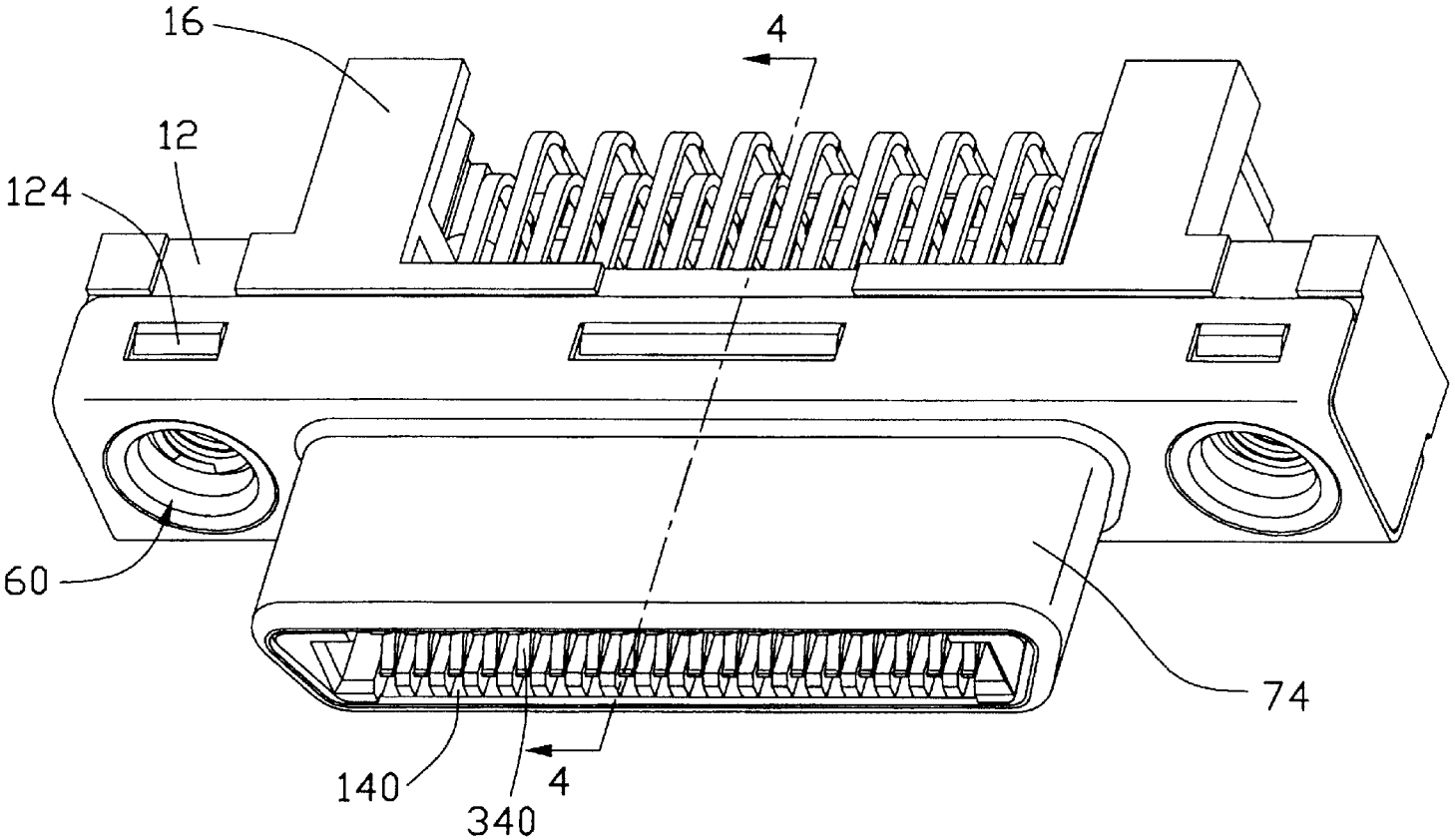
FIG. 3 is a front, assembled view of FIG. 1.
Figure 4:
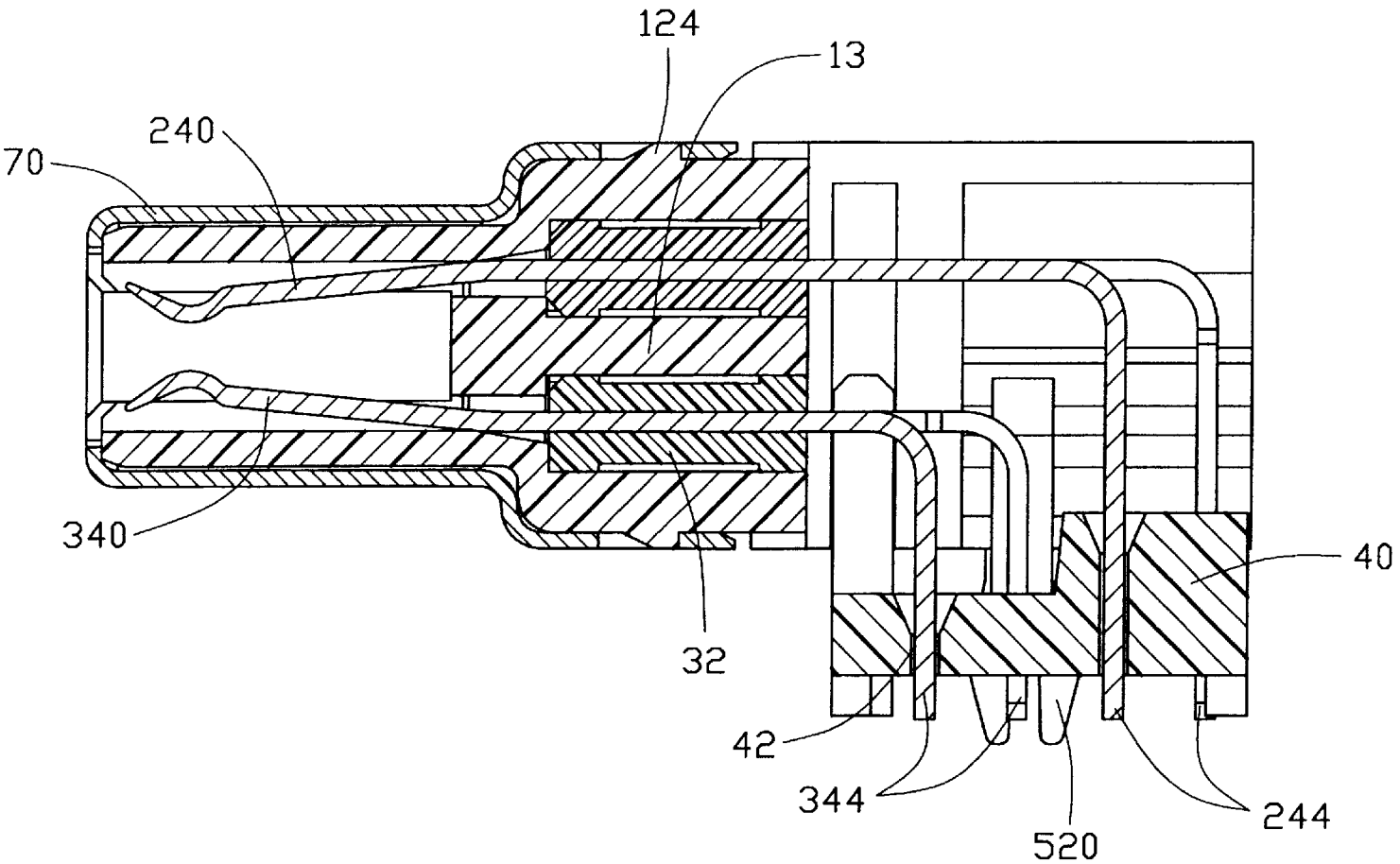
FIG. 4 is a cross-sectional view of the connector taken along section line 4—4 in FIG. 3.
Figure 5:
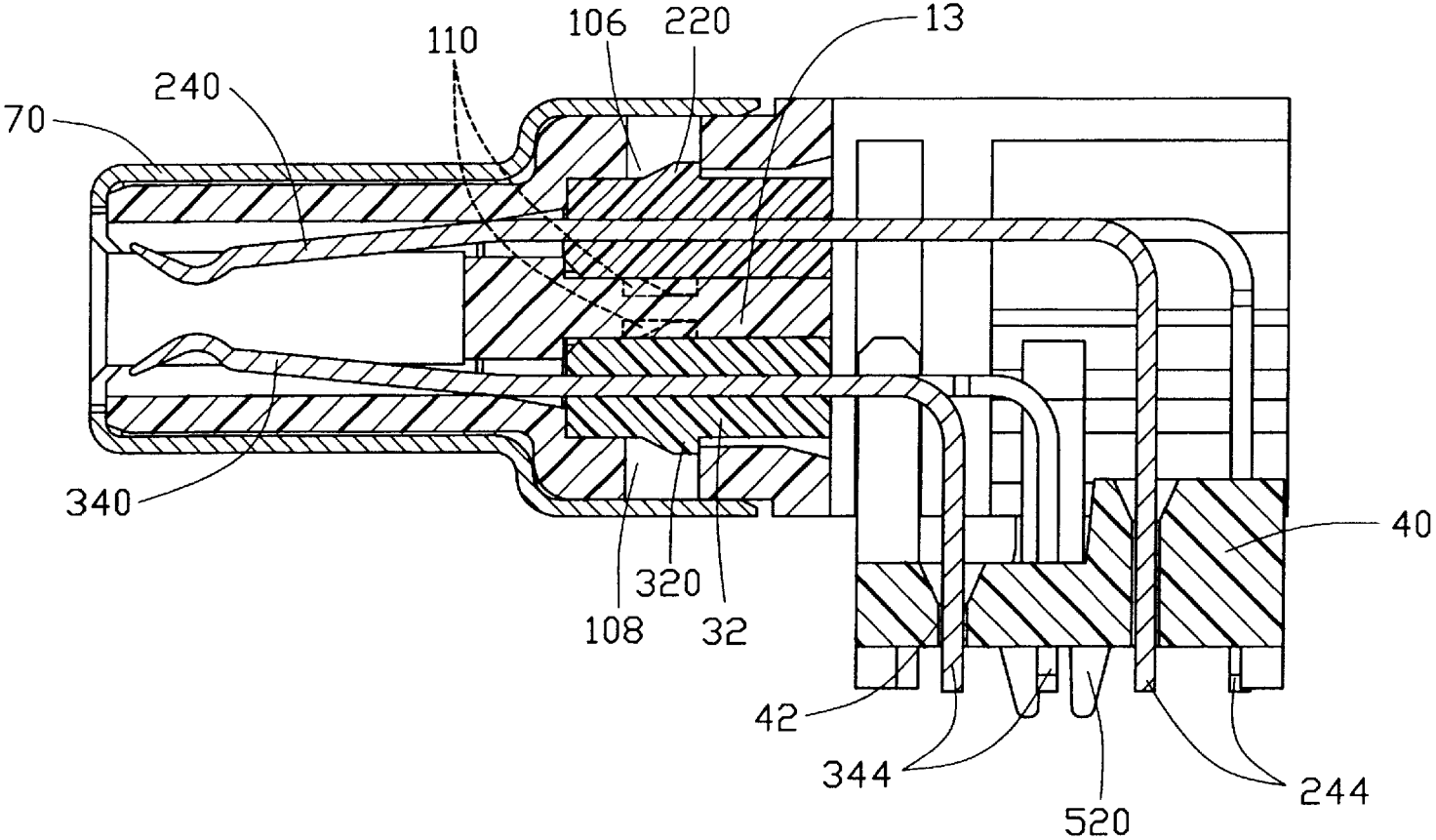
FIG. 5 is a cross-sectional view of the connector showing the terminal inserts fixedly engaging with the housing.
Figure 6:
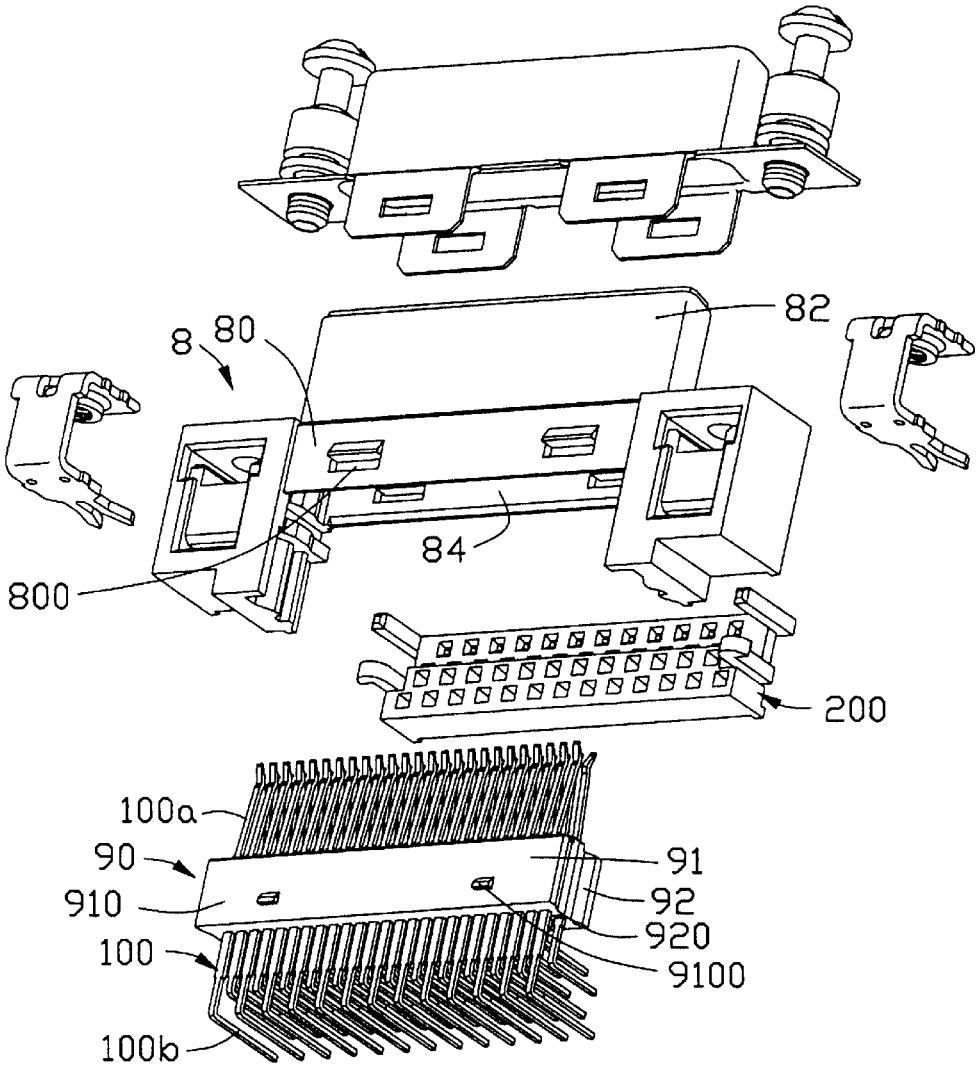
FIG. 6 (PRIOR ART)
FIG. 6 is an exploded, perspective view of a conventional electrical connector.

Referring to FIGS. 3, 4 and 5, in assembly, the board locks 50 are assembled to the housing 10 from the rear face 122, wherein the body portions 52 and the connecting portions 54 are respectively received within the slots 160 of the blocks. 16 and the recesses 126 of the base 12, whereby the through holes 540 are accurately aligned with the apertures 128. The shield 70 is then assembled to the housing 10 from the front face 120 thereof, wherein the protrusions 124 of the housing 10 engage with the holes 760 of the shield 70. The fixing holes 720 are aligned with the apertures 128 of the housing 10. The shielding portion 74 of the shield 70 encloses the shroud 14 of the housing 10. The fastening members 60 then assemble the board locks 50, the housing 10 and the shield 70 together by sequentially extending through the through holes 540, the aligned apertures 128 and the fixing holes 720 and riveting the front end of the locking portion 64 against the abutting portion 72 of the shield 70.

The first and the second terminal inserts 20, 30 are respectively inserted into the first and the second openings 102, 104 from the rear face 122 to reach a position in which the projections 220, 320 of the insulating portions 22, 32 are received and retained in the first and the second holes 106, 108 of the housing 10 and the recesses 110 of the partition 13. At this position, the ribs 130 of the partition 13 of the housing 10 snugly abut against the first and the second terminal inserts 20, 30. At the same time, the mating portions 240, 340 of the terminals 24, 34 are received in the receiving channels 140 of the housing 10, and the right-angle tail portions 244, 344 are received in the holes 42 of the spacer 40.

A feature of the present invention is that the first terminal insert 20 and the second terminal insert 30 are individually assembled to the housing 10. Due to the engagement between the projections 220, 320 and the first and the second holes 106, 108 of the housing 10 and the recesses 110 of the partition 13, and the engagement between the insulating portions 22, 32 and the ribs 130 of the partition 13 of the housing 10, the mating portions 240, 340 of the terminals 24, 34 are accurately positioned in the terminal receiving channels 140, thereby ensuring a reliable electrical connection between the electrical connector 1 and the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing defining a plurality of terminal receiving channels, and a first and a second openings in communication with the terminal receiving channels, the housing having a partition separating the first opening from the second opening; and a pair of terminal inserts respectively inserted into the first and the second openings, each terminal insert including an insulating portion and a plurality of terminals retained in the insulating portion, each terminal having a mating portion received in a corresponding terminal receiving channel; wherein the housing defines a plurality of holes and the partition defines a plurality of recesses on a top and a bottom faces thereof, the insulating portion of each terminal insert is formed with a plurality of protrusions on a top and a bottom faces thereof for being locked in the holes and recesses.

2. The electrical connector as claimed in claim 1, wherein the housing includes a base and a shroud forwardly projecting from a front face of the base, the first and the second openings are defined in a rear face of the base, and the receiving channels are defined in the shroud.

3. The electrical connector as claimed in claim 1, wherein the partition is formed with a plurality of ribs on a top and a bottom faces thereof projecting into the first and the second openings for abutting against the first and the second terminal inserts.

4. The electrical connector as claimed in claim 1, further comprising a spacer located at a rear, lower portion of the housing, and wherein each terminal has a tail portion projecting beyond the insulating portion of the terminal insert and retained in the spacer.

5. An electrical connector comprising:

an insulative housing defining first and second openings with a partition therebetween;

a shroud located in front of the housing and in communication with both said first and second openings;

a pair of terminal inserts including pairs of terminals and respectively inserted into the corresponding first and second openings, each of said terminal inserts including one row of terminals, said pairs of terminals of the pair of terminal inserts extending into the shroud in a symmetrical manner for sandwiching a board therebetween; wherein each of said terminal inserts and the corresponding opening have their own interlocking device, said housing includes a hole extending perpendicular to and in communication with one of said first and second openings, and said hole extends through an outer face of said housing.

6. The connector as claimed in claim 5, wherein each of said terminal inserts includes a projection latchably engaged within the hole for preventing the terminal insert from moving along a longitudinal direction of the corresponding opening.

* * * * *